United States Patent [19]

Ramsey

[11] Patent Number: 5,036,993

[45] Date of Patent: Aug. 6, 1991

[54] SELF-SEALING CLOSURE

[76] Inventor: Douglas P. Ramsey, 20 Ellington Cir., Rochester, N.Y. 14612

[21] Appl. No.: 619,056

[22] Filed: Nov. 28, 1990

[51] Int. Cl.[5] ..... B65D 47/20

[52] U.S. Cl. ..... 220/90.2; 220/254; 222/472; 222/516

[58] Field of Search ..... 220/90.2, 90.4, 90.6, 220/233, 241, 253, 254, 256; 222/470, 471, 472, 480, 516

[56] References Cited

U.S. PATENT DOCUMENTS

| | | | |
|---|---|---|---|
| 1,935,969 | 11/1933 | Witherspoon | 222/472 |
| 2,796,191 | 6/1957 | Belanger | 220/256 |
| 2,817,451 | 12/1957 | Giles et al. | 222/480 |
| 3,143,256 | 8/1964 | Lazure et al. | 222/480 |
| 3,915,355 | 10/1975 | Young | 220/90.2 X |
| 4,121,731 | 10/1978 | Okerstrum | 220/90.4 |
| 4,141,461 | 2/1979 | LaChance | 220/253 |
| 4,165,013 | 8/1979 | Lutz | 220/215 |
| 4,190,173 | 2/1980 | Mason et al. | 220/203 |
| 4,276,992 | 7/1981 | Susich | 220/254 |
| 4,303,173 | 12/1981 | Nergard | 220/254 |
| 4,712,704 | 12/1987 | Ramsey et al. | 220/254 |
| 4,790,444 | 12/1988 | Terzi | 220/90.2 |
| 4,915,250 | 4/1990 | Hayes, Jr. | 220/90.4 |

*Primary Examiner*—Stephen P. Garbe
*Assistant Examiner*—Vanessa M. Roberts
*Attorney, Agent, or Firm*—Howard J. Greenwald

[57] ABSTRACT

A self-sealing closure for sealing a receptacle is disclosed. The closure has a lid having a depressed area, at least one orifice within the depressed area, and a shutter matching the orifice. The shutter contains at least two different means for removably attaching the shutter to said lid.

18 Claims, 6 Drawing Sheets

SELF-SEALING CLOSURE

FIELD OF THE INVENTION

A self-sealing closure for drinking vessels is described.

BACKGROUNF OF THE INVENTION

Applicant's U.S. Pat. No. 4,712,704 describes and claims a self-sealing closure for a drinking vessel with a receptacle. The closure contains a lid having a depressed area and at least one orifice within the depressed area, a shutter matching said orifice, means for resiliently holding the shutter against the orifice, and means rotating within a plane perpendicular to the central axis of said receptacle and lid for pushing the shutter away from the orifice in a direction substantially orthogonal to the plane of the orifice. In the device of the patent, the shutter is normally in a closed position, thereby preventing the passage of fluid through it. The shutter can be moved to the open position by the application of an external force, which need not exceed about 2.8 ounces, applied along the perimeter of the shutter within a plane perpendicular to the central axis of the shutter. When the external force ceases to be applied to the shutter, the shutter spontaneously returns to its closed position.

The shutter mechanism of the closure of U.S. Pat. No. 4,712,704 is secured by a tight press fit to the top area of the receptacle. It is relatively difficult to manufacture the closure with this tight press fit. Furthermore, a user of the self-sealing closure could not readily disassemble the closure in order to clean it.

It is an object of this invention to provide a self-sealing closure which allows a user to readily disassemble the closure in order to clean it;

It is another object of this invention to provide a self-sealing closure which, after it has been disassembled, can readily be reassembled.

It is yet another object of this invention to provide a self-sealing closure with improved sealing properties.

It is yet another object of this invention to provide a self-sealing closure which can be readily and economically manufactured.

It is yet another object of this invention to provide a receptacle which is specially adapted to be attached to said self-sealing closure;

It is yet another object of this invention to provide a sealed receptacle comprised of a self-sealing closure wherein the degree of movement of the closure is limited.

SUMMARY OF THE INVENTION

In accordance with this invention, there is provided a self-sealing closure for drinking receptacles, comprised of (1) a detachable lid covering the receptacle and having a depressed top area and at least one orifice within the depressed top area, (2) a shutter matching the orifice, (3) means for resiliently holding the shutter against the orifice, and (4) means rotating within a plane perpendicular to the central axis of said receptacle and lid for pushing the shutter away from the orifice in a direction substantially orthogonal to the plane of the orifice.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
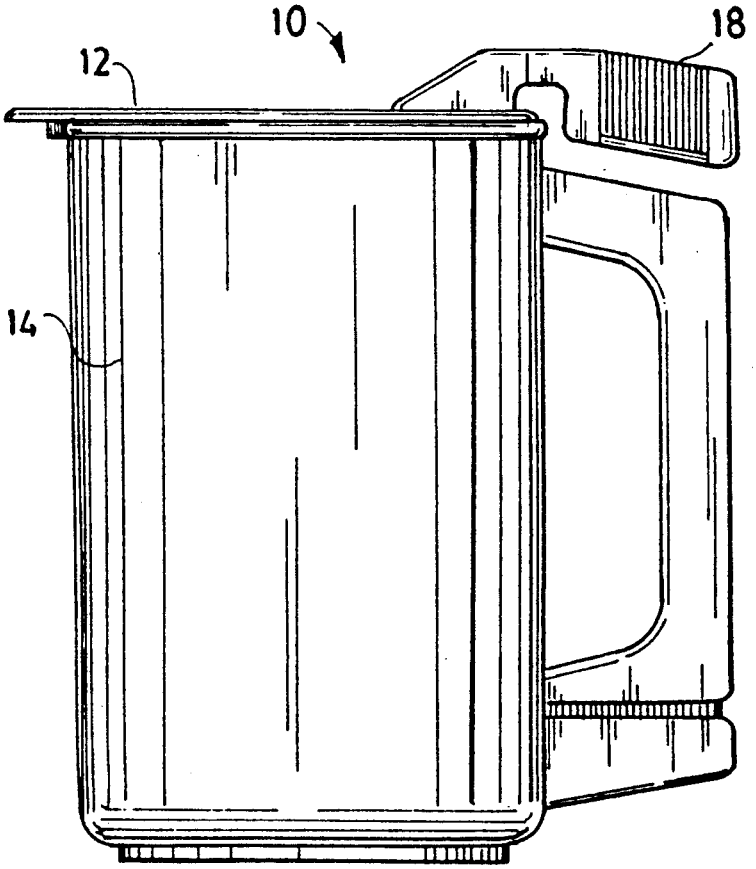
FIG. 1 is a perspective view of one preferred embodiment of the closure of the invention.

FIG. 1 is a perspective view of one preferred embodiment of the self-sealing closure 10 of this invention. Closure 10 is comprised of cover 12 and a lid (not shown). In the embodiment illustrated in FIG. 1, closure 10 is shown as being removably attached to receptacle 14.

In the embodiment illustrated in FIG. 1, closure 10 is shown as having a substantially circular cross section, and it thus is adapted to be removably attached to the substantially cylindrical receptacle 14. It is to be understood that the closure 10 of this invention may be used with any shaped receptacle, and its geometry may be readily adapted to fit said receptacle. Thus, by way of illustration, the closure may have a cross-sectional shape which is square, rectangular, triangular, irregularly shaped, and the like.

In one preferred embodiment, the closure device of this invention is usually used with a vessel for drinking or for holding and pouring powdered and/or liquid substances which is generally comprised of a cup-shaped receptacle.

Figure 2:
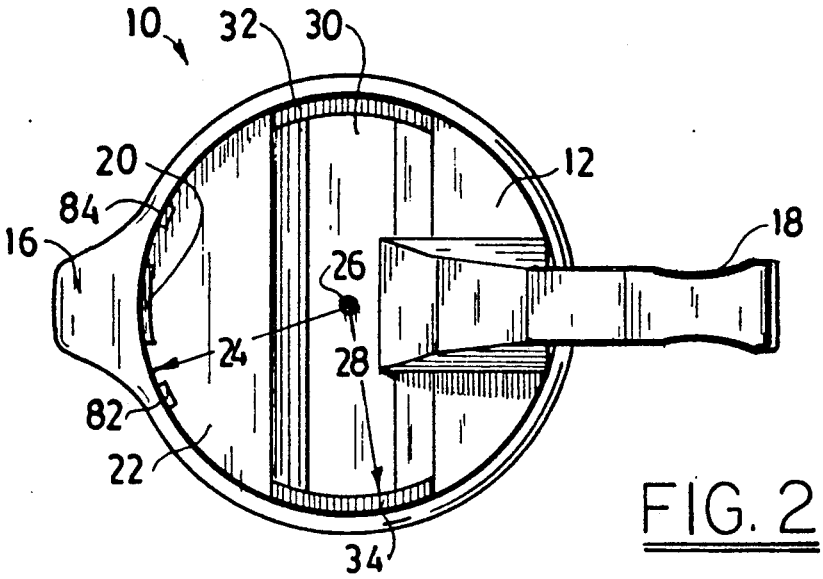
FIG. 2 is a top view of the embodiment of FIG. 1.

FIG. 2 is a top view of the closure device 10 of the invention. Referring to FIG. 2, it will be seen that closure 10 is comprised of cover 12 and lid 16. Cover 12 is integrally formed with and comprises a lever 18.

The closure device 10 of this invention is self-sealing. The term self-sealing, as used in this specification, refers to a closure device which (1) is normally in a closed position, in which it prevents the passage of fluid through it, (2) can be moved to an open position by the application of an external force, and (3) will spontaneously return to the closed position once the external force has been removed. In the embodiment illustrated in FIGS. 1 and 2, the external force may be applied to lever 18.

In the preferred embodiment illustrated in FIG. 2, lid 16 is comprised of a first horizontally-extending guide slot which is integrally formed as a part of lid 16 and which is adapted to guide the movement of cover 12.

Referring again to FIG. 2, it will be seen that cover 12 contains at least two substantially concentric sections with different radii. Section 22 of cover 12 has a radius 24 (as measured from midpoint 26) which is greater than the radius 28 of section 30. It will be apparent to those skilled in the art that the use of at least two sections with different radii on cover 12 creates flow paths 32 and 34 when cover 12 is removably attached to lid 16.

It will be apparent to those skilled in the art that, when the geometry of lid 16 is changed, the corresponding geometry of cover 12 also should change. In any event, in this preferred embodiment, the cover should be so configured that, on at lest one portion of at least two different sides of the cover, the cover, when removably attached to the lid, will not cover the entire portion of the lid, thereby providing flow paths.

Figure 3:
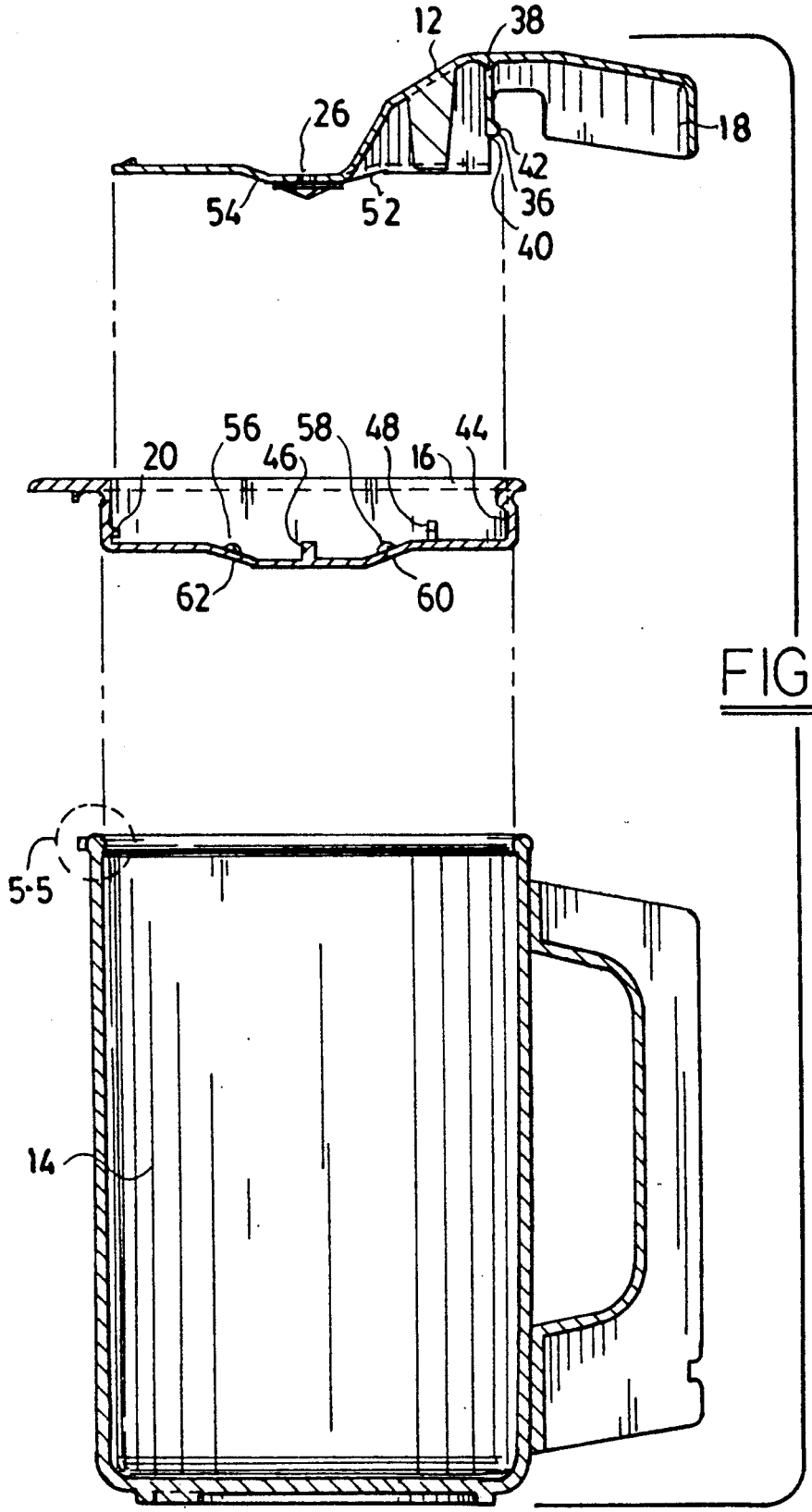
FIG. 3 is an exploded perspective view of the embodiment of FIG. 1.

FIG. 3 is an exploded perspective view of the self-sealing closure of FIG. 1.

Referring to FIG. 3, it will be seen that cover 12 comprises a projection 36 adapted to removably attach cover 12 to lid 16. This "finger snap" projection 36 is preferably integrally formed as part of cover 12 and preferably extends downwardly from point 38 to point 40, terminating in hook 42. Hook 42 is adapted to be received within undercut area 44 of lid 16, thereby removably attaching said cover 12 to said lid 16 when they are forced together.

Referring again to FIG. 3, lid 16 is comprised of an upwardly-extending finger 46 which is adapted to fit within orifice/midpoint 26 of cover 12. The combination of finger 46 and midpoint/orifice 26 helps center cover 12 when it is pushed down onto lid 16, and the force fit of finger 46 in orifice 26 provides one means of removably attaching cover 12 to lid 16.

In the closure device 10 of this invention, it is preferred that there be at least two means of removably attaching cover 12 to lid 16. One such means is the self-centering combination of finger 46 and midpoint-/orifice 26. Another such means is guide slot 20. Yet a third such means is the combination of projection 36 and undercut 44. Yet a fourth such means is the combination of the notch and receptacle illustrated in FIGS. 4, 5, and 5A.

Without wishing to be bound to any particular theory, applicant believes that, because the closure of this invention comprises at least two separate means for removably attaching the cover 12 to the lid 16, such attachment is more secure than it would be were only one such attachment means to be used.

Referring again to FIG. 3, cover 12 is comprised of a downwardly extending spring 50 which is designed to fit between two upwardly extending slots, only one of which (slot 48) is shown in FIG. 3. The spring 50, which is an elastic body which preferably is about 0.06 inches thick, limits the extent to which the cover 12 may be rotated in a direction substantially orthogonal to the plane of orifice 26. When cover 12 has been rotated in a direction substantially orthogonal to the plane of orifice 26, the combination of spring 50 and said upwardly extending slots provide a first means tending to return the shutter to its normally closed position. In addition, the provision of ramp surfaces on the cover 16 provide a second means for returning the shutter to its normally closed position.

Referring again to FIG. 3, it will be seen that, in the preferred embodiment of this Figure, cover 12 is comprised of ramps 52 and 54, which are adapted to mate with dimples 56 and 58 of lid 16.

There are at least two dimples 56 and 58 on the interior surface of lid 16. In one preferred embodiment, illustrated in FIG. 12, there are four such dimples (dimples 56, 58, 57, and 59). When cover 12 is removably attached to lid 16, and the closure is in its normally closed position, each of ramp surfaces 52 and 54 is contiguous with at least one of said dimples.

In a preferred embodiment, lid 16 also is comprised of ramps 60 and 62.

Without wishing to be bound to any theory, applicant believes that the provision of at least two separate means for limiting the extent to which the cover 12 may be rotated in a direction substantially orthogonal to the plane of orifice 26 substantially increases the efficiency of applicant's closure. The first such means is the combination of spring 50 and said upwardly extending slots. The second such means is the combination of the ramp structures contained in cover 12 and the dimples 56 and 58.

Figure 4:
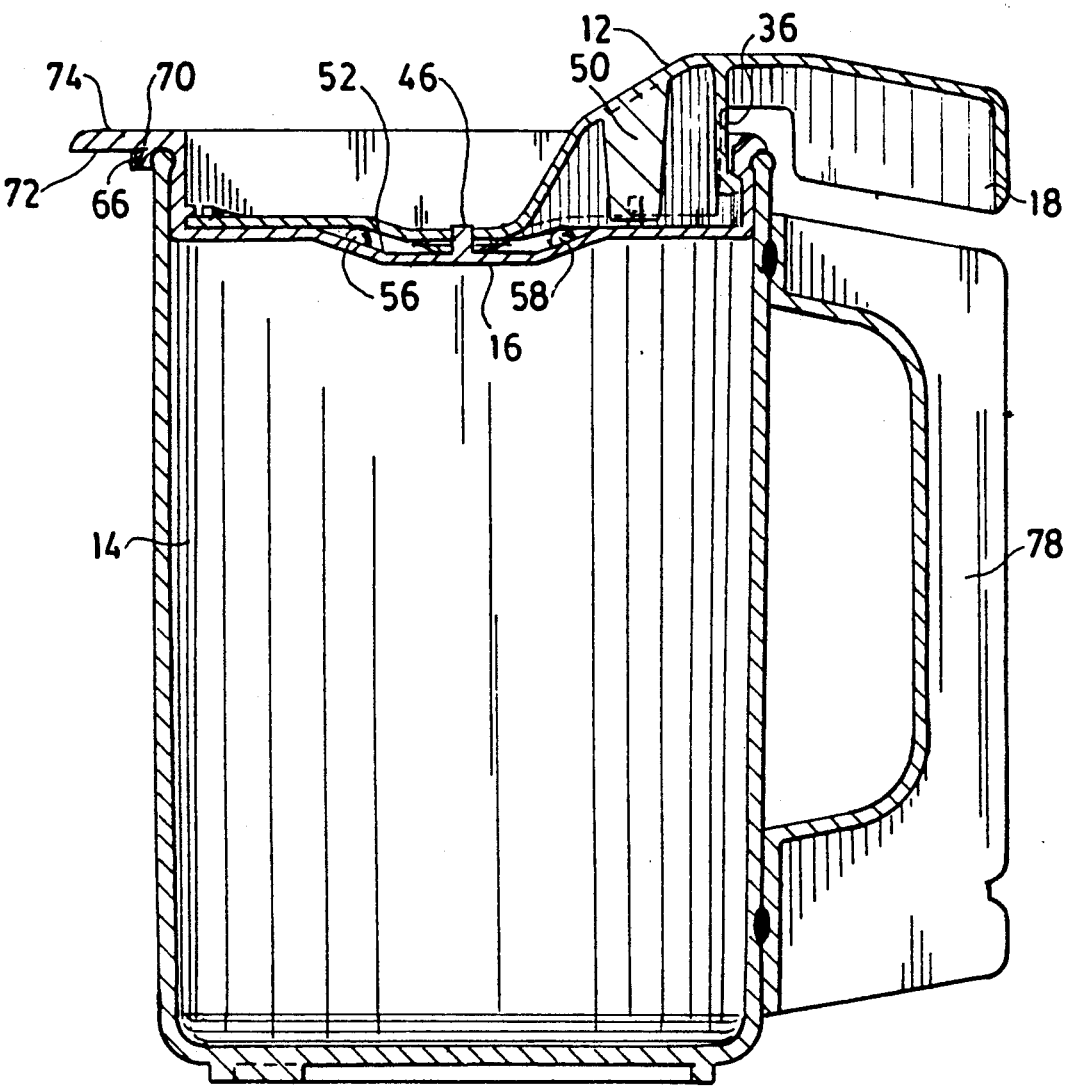
FIG. 4 is a sectional view of the embodiment of FIG. 1.
Figure 5:
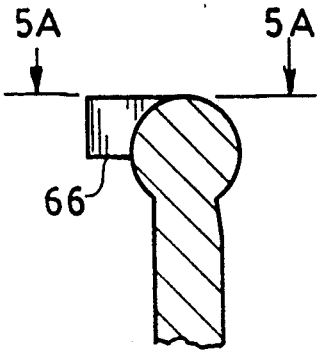
FIG. 5 is a sectional view, taken along lines 5—5 of FIG. 3, illustrating one means of locking the closure onto a receptacle.

FIG. 4 illustrates that, when cover 12 and lid 16 are removably attached to each other, several means are provided which tend to maintain the cover and lid in fixed spatial relationship to each other.

Referring to FIG. 4, the friction fit between upwardly extending finger 46 and orifice/midpoint 26 tends to maintain cover 12 and lid 16 in a fixed spatial relationship.

Referring again to FIG. 4, the positioning of spring 50 between the upwardly extending slot also tends to maintain cover 12 and lid 16 in a fixed spatial relationship.

Referring again to FIG. 4, the friction fit of hook 42 within undercut 44 also tends to maintain cover 12 and lid 16 in a fixed spatial relationship.

In one preferred embodiment, means are provided for removably attaching closure 10 to receptacle 14. One such means is the friction fit between said closure 10 and said receptacle 14. Another such means is the is the notch and receptacle arrangement illustrated in FIGS. 4, 5, and 5A.

Figure 5A:
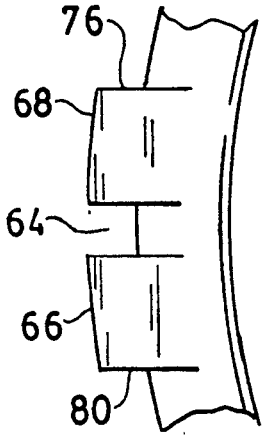
FIG. 5A is a top view of the locking means of FIG. 5.

Referring to FIG. 5A, it will be seen that the receptacle 14 illustrated in said Figure is comprised of a notch 64, which is integrally formed as a part of the perimeter of receptacle 14. As will be seen by referring to FIG. 5A, notch 64 is formed by horizontally-extending fingers 66 and 68.

A key 70 extends downwardly from the lower surface 72 of tab 74. This key 70 may be disposed to fit within notch 64, in which case lid 16 is centered on receptacle 14. Alternatively, key 70 may be disposed to fit on side 76 of finger 68, in which case the lid 16 is offset to the left of the handle 78 of the receptacle 14. Alternatively, key 70 may be disposed to fit on side 80 of finger 66, in which case the lid 16 is offset to the right of the handle 78. With this arrangement, a user may dispose the lever 18 to the left or the right of handle 78

(depending upon whether he is left-handed or right handed) or, alternatively, center such lever.

Figure 6:
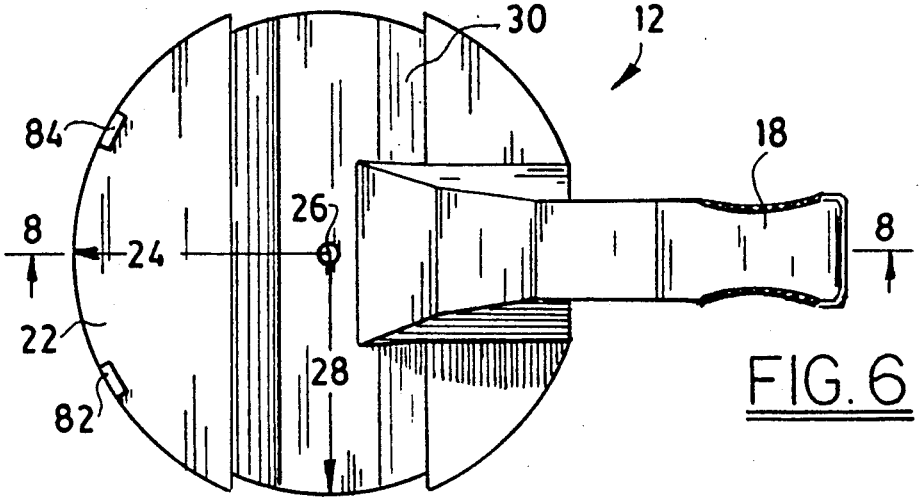
FIG. 6 is a top view of the cover used in the closure of FIG. 1.
Figure 7:
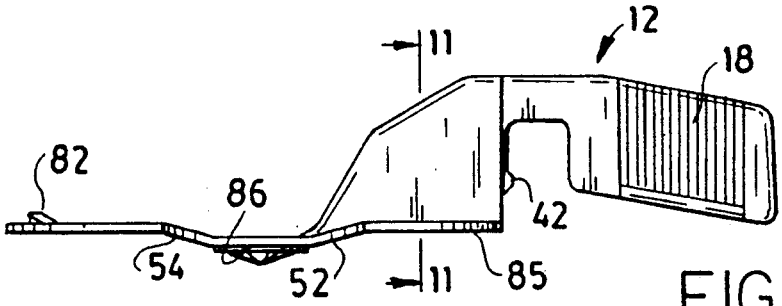
FIG. 7 is a side view of the cover of FIG. 6.
Figure 8:
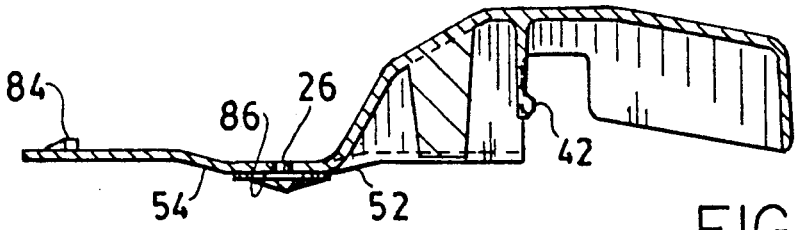
FIG. 8 is a sectional view of the cover of FIG. 6, taken along lines 8—8 of FIG. 6.

FIG. 6 is a top view of the cover 12 of the preferred closure 10 of this invention. Referring to FIG. 6, it will be seen that cover 12 is preferably comprised of at least two upwardly extending projections 82 and 84 which are adapted to contact guide slot 20 when cover 12 has been rotated beyond a certain point; projection 82 is also shown in FIGS. 7 and 8. This means for limiting the rotation of cover 12 may be better seen by reference to FIG. 2.

FIG. 7 is a side view of the cover 12 of FIG. 6. It will be noted that the bottom surface 85 of cover 12 is comprised of ramps 52 and 54. It is also comprised of a relatively level section 86. As will be seen from FIG. 8, level section 86 is near midpoint/orifice 26.

Figure 9:
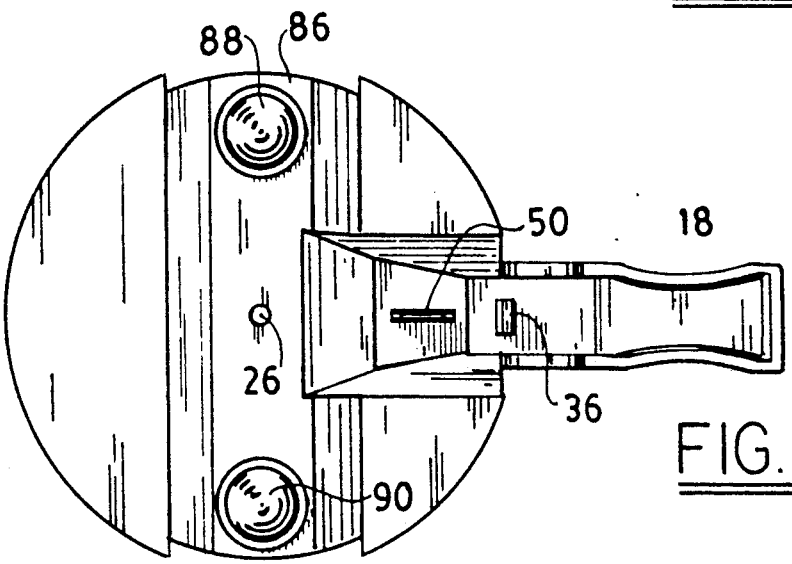
FIG. 9 is a bottom view of the cover of FIG. 6.

On the bottom surface of level section 86 is at least one dimple 88 which is adapted to mate with a corresponding orifice in lid 16. Referring to FIG. 9, which is a bottom view of cover 12, it will be seen that cover 12 is preferably comprised of at least two downwardly extending dimples 88 and 90. These dimples are preferably located on section 30 of cover 12.

Figure 10:
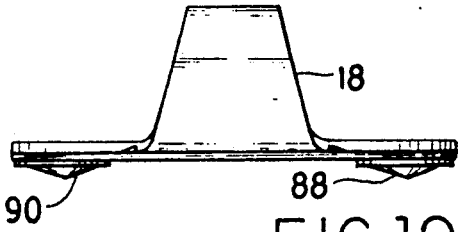
FIG. 10 is an end view of the cover of FIG. 6.

FIG. 10 is a back view of cover 12.

Figure 11:
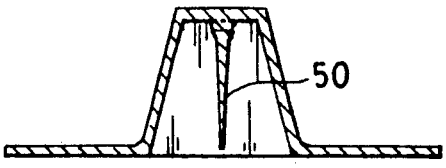
FIG. 11 is a sectional end view of the cover of FIG. 6.

FIG. 11 is a sectional view of cover 12, taken as shown in FIG. 7. The downwardly extending spring 50 is shown. Spring 50 may comprise or consist essentially of elastic material which, after it has been deformed and the deforming force has been removed, will return to its original shape.

Figure 12:
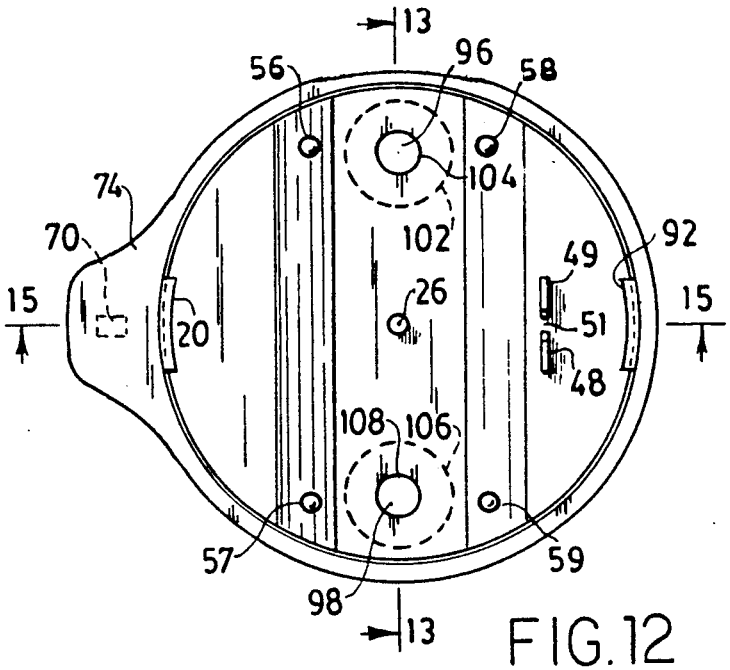
FIG. 12 is a top view of the lid of the closure of FIG. 1.

FIG. 12 is a top view of lid 16. Referring to FIG. 12, it will be seen that lid 16 is comprised of slot guides 48 and 49 defining a slot 51 between them in which spring 50 may be disposed. Lid 16 is also comprised of means 92 for removably attaching cover 12 to lid 16.

Figure 13:
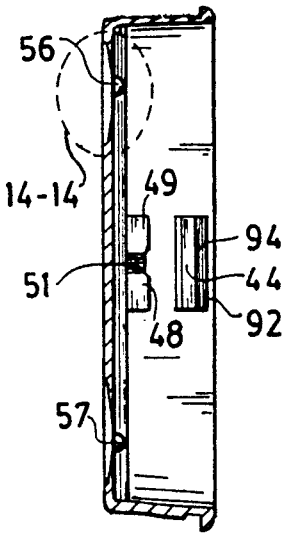
FIG. 13 is a sectional view, taken along lines 13—13 of FIG. 12, of the lid of FIG. 12.

Means 92 is illustrated in FIG. 13. As will be apparent to those skilled in the art, when cover 12 is forced onto lid 16, hook 42 of downwardly extending projection 36 (not shown) will be forced over protrusion 94 into undercut area 44, where it will nest until displaced by the application of a suitable amount of force.

Figure 14:
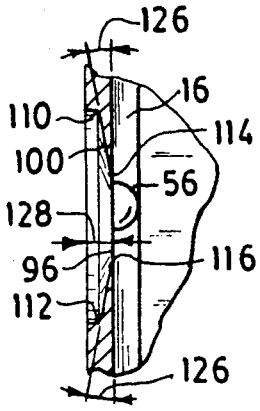
FIG. 14 is a partial exploded view of the thin walled orifice used in the lid of FIG. 12.

FIG. 14 is a sectional view, taken as shown in FIG. 13, illustrating downwarldy extending dimple 88. Referring to FIG. 14, dimple 88 partially extends through orifice 96 of lid 16. Downwardly extending dimple 90 (not shown) also partially extends through orifice 98 (not shown) of lid 16.

As is illustrated in FIG. 14, each of orifices 96 and 98 preferably comprises a recessed section 100 on the bottom surface of lid 16..

Referring again to FIG. 12, each of orifices 96 and 98 is defined by concentric circles 102, 104 (for orifice 96) and concentric circles 106 and 108 (for orifice 98). The material enclosed between circles 102 and 104, and between circles 106 and 108, preferably has a substantially smaller thickness than the material which exists outside of such concentric circles. This thin-walled feature of the material defining orifices 96 and 98 is an important part of applicant's invention.

The level section 86 lid 16 preferably has a width which is substantially the same as the width of the other sections of lid 16 (excluding the thin walled sections surrounding orifices 96 and 98). In any event, it is preferred that the width of level section 86 be greater than the width of the thin walled sections surrounding orifices 96 and 98.

Referring again to FIG. 14, it will be seen that the thin walled section surrounding orifice 96 tapers from points of maximum thickness (see points 110 and 112) to points of minimum thickness (see points 114 and 116). At the points of maximum thickness, the thickness of the thin-walled section is still substantially smaller than the thickness of the surrounding material comprising level section 86. In one embodiment, the thickness of the level area 86 is at least about 1.2 times as great as the maximum thickness of the thin walled section.

Without wishing to be bound to any particular theory, applicant believes that the relativey thin walled sections surrounding the orifices more readily conform to the shape of the dimple 88 or 90 and, thus, form a better seal with such dimples. In one embodiment, it is preferred that the average thickness of such thin-walled section be from 0.008 to about 0.030 inches.

Referring again to FIG. 14, it is preferred that dimples 88 and 90 have a substantially conical shape.

Figure 15:
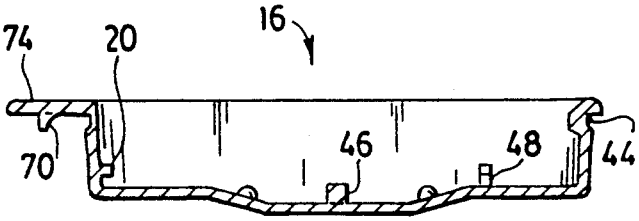
FIG. 15 is a sectional view, taken along lines 15—15 of FIG. 12, of the lid of FIG. 12.

FIG. 15 is a sectional view, taken as shown in FIG. 12, illustrating lid 16.

Figure 18:
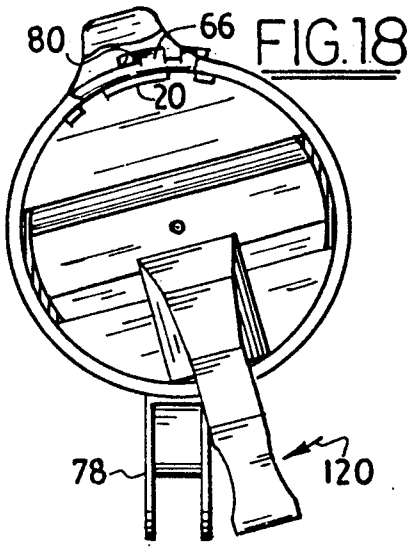
FIGS. 16, 17, 18, 19, and 20 illustrate the operation of the closure of FIG. 1.
Figure 16:
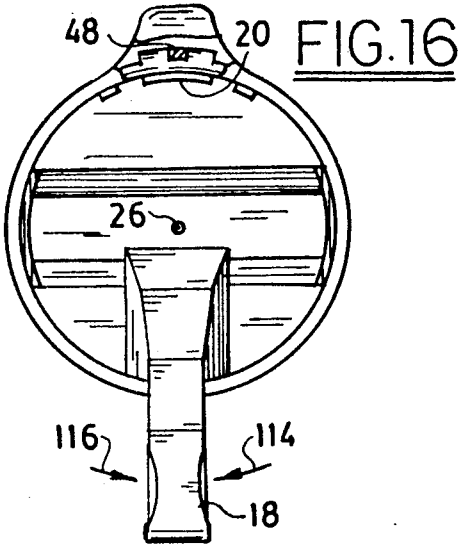
Figure 17:
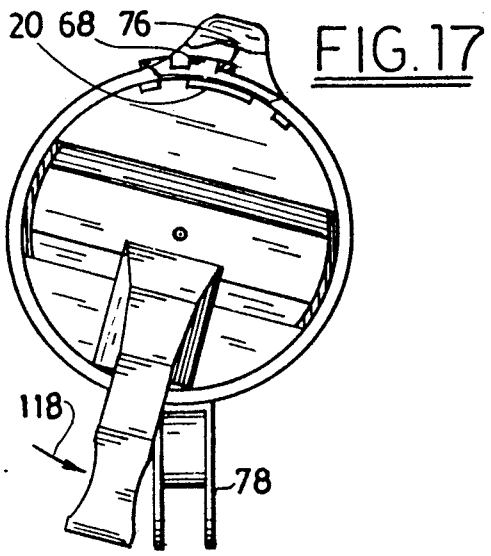

FIGS. 16, 17, and 18 illustrate the versatility of applicant's novel closure device. Referring to FIG. 16, key 70 is disposed within slot guide 48, and thus cover 12 is so attached to lid 16 that lever 18 is substantially aligned with handle 78 (not shown). From this position, a user may rotate cover 12 in the direction of either arrow 114 or 116 to open the closure in either the left or right direction.

Alternatively, one may lock the closure in the position illustrated in FIG. 17. In this position, key 70 may be disposed to fit on side 76 of finger 68, in which case the lid 16 is offset to the left of the handle 78 of the receptacle 14. From this position, a user may rotate cover 12 in the direction of arrow 118 in order to open the closure.

Alternatively, key 70 may be disposed to fit on side 80 of finger 66, in which case the lid 16 is offset to the right of the handle 78. From this position, a user may rotate cover 12 in the direction shown by arrow 120 to open the closure.

Figure 21:
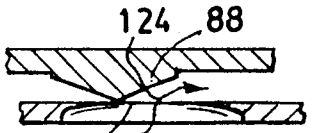
FIGS. 21 and 22 illustrate how the dimples of the cover seal the orifices of the lid of the closure of this invention once they are suitably aligned.
Figure 22:
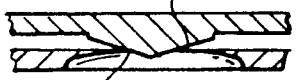
Figure 20:
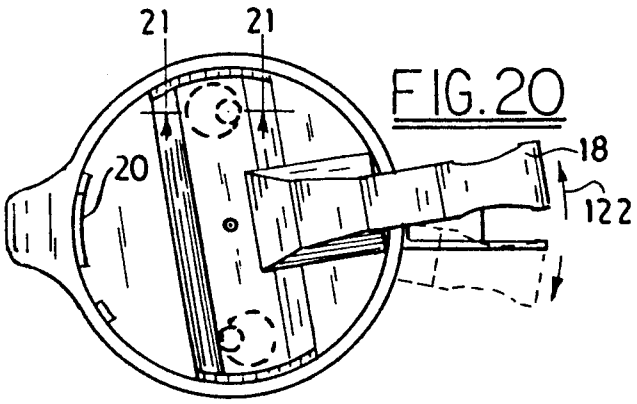
Figure 19:
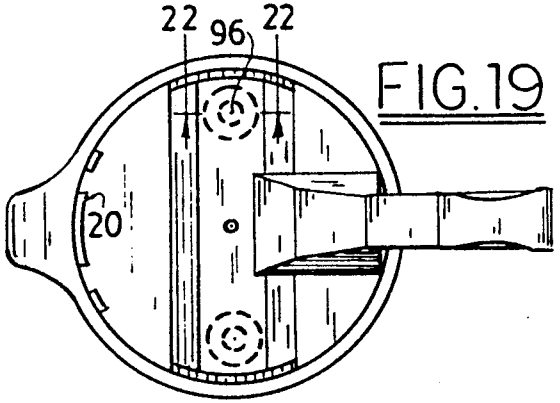

FIG. 19 illustrates closure 10 in its closed position, and FIG. 22 is a cross-sectional view taken through orifice 96 in such position. FIG. 20 illustrates closure 10 in an open position, and FIG. 21 is a cross-sectional view taken through orifice 96 in such position.

Referring to FIG. 21, it will be seen that the rotation of lever 18 in the direction of arrow causes the cover 12 to ride up the ramp, thereby forcing cover 12 (and its corresponding downwardly extending dimples 88 and 90) up away from lid 16. The reason for this is illustrated in FIG. 12.

Referring to FIG. 12, it will be seen that the relatively level section 86 of cover 12 rests upon 56, 57, 58, and 59 when the closure 10 is in its closed position. When one attempts to open the closure 10 by rotating lever 18 to either side, however, the relatively level section moves towards ramps 60 and 62 of lid 16. As this relatively level section 86 contacts ramps 60 and 62, it is forced by the incline of the ramps up away from the orifices 96 and 98, thereby pulling such downwardly extending dimples 88 and 90 away from the orifices 96 and 98. In such position, fluid may flow through the orifices 96 and 98 and thence through flow paths 32/or 34 to the user. Pressure must be maintained on the lever 18 in order to keep the orifices 96 and 98 open. In the first place, the elastic nature of spring 50 will tend to return the closure 10 to its closed position. In the second place, the elastic nature of cover 12 (which is flexed as it rides up the ramps 60 and 62) will tend to return the closure 10 to its closed position.

Referring again to FIG. 21, which shows the dimple 88 in a position of unstable equilibrium with regard to orifice 96, it will be seen that, because dimple 88 is raised up away from orifice 96, fluid may flow in the direction of arrow 124.

By comparison, and referring to FIG. 22, it will be seen that when the pressure is released on lever 18, the dimple 88 returns downwardly in a nesting position within orifice 96, thereby sealing such orifice.

In one preferred embodiment, the closure is so constructed that lever 18 requires no more than about 2.8 ounces of force applied along the perimeter of the lid within a plane perpendicular to the central axis (midpoint 26) of the lid to move the cover from its normally closed position to its open position. In one embodiment, the force required to move the cover from the closed to the open position does not exceed about 2.0 ounces.

It is preferred that each of the components of the closure device 10 of this invention be comprised of a polymeric material. In a more preferred embodiment, the closure device 10 consists essentially of a polymeric material. By way of illustration and not limitation, some of the polymeric materials which may be used include, e.g., polyesters, linear polyamides, polyurethanes, and the like. Polymeric materials which may be used in the invention are described in, e.g., B. Golding's "Polymers and Resins" (D. Van Nostrand Company, Inc., Princeton, N.J., 1959), the disclosure of which is hereby incorporated by reference into this specification.

One of the preferred classes of materials which can be used in the closure of this invention are the polyolefin resins. These resins are well known to those skilled in the art and are described in, e.g., pages 568–569 of Volume 10 of the "McGraw-Hill Encyclopedia of Science and Technology" (McGraw-Hill Book Company, N.Y., 1977), the disclosure of which is hereby incorporated by reference into this specification.

In one preferred embodiment, the polyolefin resin is selected from the group consisting of high density polyethylene, ultra-high density polyethylene, and mixtures thereof.

In another embodiment, the polyolefin resin is polypropylene.

The polymeric material may be polycarbonate. These polycarbonates are well known to those skilled in the art and are described, e.g., on pages 143–178 of R. Seymour's "Engineering Polymer Sourcebook" (McGraw-Hill Book Company, N.Y., 1990), the disclosure of which is hereby incorporated by reference into this specification.

One class of materials which can be used are the polyacrylonitrile resins. These resins are described in, e.g., pages 534–535 of said "McGraw-Hill Encyclopedia of Science and Technology," supra. The preferred polyacrylonitrile resins are acrylonitrile-butadiene-styrene (ABS) resins.

In one embodiment, the cover 12 consists essentially of polycarbonate, the lid 16 consists essentially of a material selected from the group consisting of polypropylene, polyethylene, and mixtures thereof, and the receptacle 14 preferably consists essentially of polypropylene.

In one preferred embodiment the downwardly extending dimples 88 and 90 each have a substantially conical shape with a taper of from about 0 to about 30 degrees; referring to FIG. 14, such taper is the angle defined as 126. Said dimples 88 and 90 also have a depth and a depth of from about 0.020 to about 0.060 inches. In this embodiment, the orifices 96 and 98 which cooperate with dimples 88 and 90 also have a taper. The taper from the perimeter of concentric circle 106 to the perimeter of concentric circle 108 (see FIG. 12), and from the perimeter of concentric circle 102 to the perimeter of concentric circle 104), as measured on the bottom surface of lid 16, will generally be from about 3 to about 9 degrees. The thickness of the wall section as measured at the knife edge of circles 108 and/or 104 will be from about 0.003 to about 0.020 inches thick.

Without wishing to be bound to any particular theory, applicant believes that the use of such tapered components insures a good seal between cover 12 and lid 16 when the closure is in the closed position.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

I claim:

1. A self-sealing closure for sealing a receptacle, said closure comprising a lid having a depressed area and at least one orifice within the depressed area, a shutter matching said orifice, means for holding the shutter against said orifice, and means rotating within a plane perpendicular to the central axis of said receptacle and lid for pushing the shutter away from said orifice in a direction substantially orthogonal to the plane of said orifice, wherein:

(a) said shutter is normally in a closed position in which the passage of fluid through it is prevented, (b) said shutter can be moved from its closed position to an open position by the application of an external force applied along the perimeter of the shutter within a plane perpendicular to the central axis of the shutter, (c) when said external force ceases to be applied to the shutter, the shutter spontaneously returns to its closed position, (d) said closure is comprised of means for limiting the extent to which said shutter may be pushed away from said orifice in a direction substantially orthogonal to the plane of said orifice, (e) said lid is comprised of a first, horizontally-extending guide slot which is integrally formed as part of said lid, (f) said shutter is comprised of at least two different means for removably attaching said shutter to said lid, wherein at least one of said means comprises a first projection integrally formed with and extending downwardly from said shutter, (g) said shutter is comprised of a second projection integrally formed with and extending downwarldy from said shutter, and (h) said lid is comprised of at least two adjacent, integrally formed, upwardly extending projections defining a slot therebetween.

2. The closure as recited in claim 1, wherein said closure consists of said lid and said shutter.

3. The closure as recited in claim 1, wherein said closure has a cross-sectional shape which is substantially circular.

4. The closure as recited in claim 1, wherein said first projection is comprised of a hook.

5. The closure as recited in claim 1, wherein said lid is comprised of an upwardly-extending finger.

6. The closure as recited in claim 1, wherein said shutter is comprised of at least one orifice.

7. The closure as recited in claim 1, wherein said second projection is an elastic body.

8. The closure as recited in claim 1, wherein said lid is comprised of at least two dimples on one surface of said lid.

9. The closure as recited in claim 8, wherein said lid is comprised of at least four dimples on one surface of said lid.

10. A receptacle comprised of a self-sealing closure, wherein said closure comprises a lid having a depressed area and at least one orifice within the depressed area, a shutter matching said orifice, means for holding the shutter against said orifice, and means rotating within a plane perpendicular to the central axis of said receptacle and lid for pushing the shutter away from said orifice in a direction substantially orthogonal to the plane of said orifice, and wherein:

(a) said shutter is normally in a closed position in which the passage of fluid through it is prevented, (b) said shutter can be moved from its closed position to an open position by the application of an external force applied along the perimeter of the shutter within a plane perpendicular to the central axis of the shutter, (c) when said external force ceases to be applied to the shutter, the shutter spontaneously returns to its closed position, (d) said closure is comprised of means for limiting the extent to which said shutter may be pushed away from said orifice in a direction substantially orthogonal to the plane of said orifice, (e) said lid is comprised of a first, horizontally-extending guide slot which is integrally formed as part of said lid, (f) said shutter is comprised of at least two different means for removably attaching said shutter to said lid, wherein at least one of said means comprises a first projection integrally formed with and extending downwardly from said shutter, (g) said shutter is comprised of a second projection integrally formed with and extending downwarldy from said shutter, and (h) said lid is comprised of at least two adjacent, integrally formed, upwardly extending projections defining a slot therebetween.

11. The receptacle as recited in claim 10, wherein said closure consists of said lid and said shutter.

12. The receptacle as recited in claim 10, wherein said closure has a cross-sectional shape which is substantially circular.

13. The receptacle as recited in claim 10, wherein said first projection is comprised of a hook.

14. The receptacle as recited in claim 10, wherein said lid is comprised of an upwardly-extending finger.

15. The receptacle as recited in claim 10, wherein said shutter is comprised of at least one orifice.

16. The receptacle as recited in claim 10, wherein said second projection is an elastic body.

17. The receptacle as recited in claim 10, wherein said lid is comprised of at least two dimples on one surface of said lid.

18. The receptacle as recited in claim 10, wherein said lid is comprised of at least four dimples on one surface of said lid.

* * * * *